US005784913A

United States Patent [19]

Bhandari

[11] Patent Number: 5,784,913

[45] Date of Patent: Jul. 28, 1998

[54] PRESSURE DIE ASSIST BOOST SYSTEM FOR TUBE BENDING MACHINE

[75] Inventor: Ajay K. Bhandari, Westlake, Ohio

[73] Assignee: Pines Manufacturing, Westlake, Ohio

[21] Appl. No.: 540,064

[22] Filed: Oct. 6, 1995

[51] Int. Cl.[6] ..... B21D 7/04; B21D 9/05; B21B 37/08

[52] U.S. Cl. ..... 72/149; 72/157; 72/20.2; 72/21.5; 72/20.1

[58] Field of Search ..... 72/142, 155, 159, 72/157, 13.1, 13.4, 20.1, 21.4, 19.9, 158, 20.2, 21.5

[56] References Cited

U.S. PATENT DOCUMENTS

| | | | |
|---|---|---|---|
| 3,553,989 | 1/1971 | Munro et al. | 72/20.1 |
| 3,553,990 | 1/1971 | Suding et al. | 72/20.1 |
| 4,038,853 | 8/1977 | Schwarze | 72/157 |
| 4,178,788 | 12/1979 | Zollweg et al. | 72/155 |
| 4,236,398 | 12/1980 | Schwarze | 72/157 |
| 4,495,788 | 1/1985 | Traub | 72/157 |
| 4,747,283 | 5/1988 | Moore et al. | 72/8 |
| 4,765,168 | 8/1988 | Stange et al. | 72/159 |
| 4,888,971 | 12/1989 | Schwarze | 72/157 |
| 4,970,885 | 11/1990 | Chipp et al. | 72/8 |
| 5,259,224 | 11/1993 | Schwarze | 72/24 |
| 5,275,031 | 1/1994 | Whiteside et al. | 72/10 |
| 5,343,725 | 9/1994 | Sabine | 72/155 |
| 5,426,965 | 6/1995 | Hopf | 72/149 |

*Primary Examiner*—Lowell A. Larson
*Assistant Examiner*—Rodney Butler
*Attorney, Agent, or Firm*—Pearne, Gordon, McCoy & Granger LLP

[57] ABSTRACT

A machine for cold bending a thick walled tube is provided which includes a rotatable bend die around which the tube is bent and a pressure die which engages an outer side wall of the tube tangential to the bend. The pressure die has a pinch-type tube groove with multiple radiuses which receives the tube and substantially prevents relative movement between the pressure die and the outer side wall of the tube. The machine also includes a pressure die boost system which linearly advances the pressure die in a forward direction as the bend die is rotated. The boost system includes a linear actuator and an electro-hydraulic control system which automatically drives the linear actuator in accordance with a pre-programmed profile of pressure and flow parameters. The linear actuator has a hydraulic cylinder with a piston, a pusher coupling the piston to the pressure die, and ports in the cylinder on opposite sides of the piston. The electro-hydraulic control system has a hydraulic pump which provides hydraulic fluid to the cylinder, a proportional flow directional valve which varies flow of the hydraulic fluid from the hydraulic pump to each of the ports, a proportional pressure control valve which varies pressure of the hydraulic fluid in the cylinder, a sensor which detects a rotational angle of the bend die, and a microprocessor based controller. The controller receives a signal from the sensor representative of the rotational angle of the bend die and sends control signals to the valves to set the flow and pressure of the hydraulic fluid to pre-programmed levels at pre-programmed rotational angles of the bend die.

20 Claims, 4 Drawing Sheets

PRESSURE DIE ASSIST BOOST SYSTEM FOR TUBE BENDING MACHINE

BACKGROUND OF THE INVENTION

1. Field of the Invention

The present invention generally relates to a boost system for a pressure die of a tube bending machine, and more particularly, to a boost system which advances the pressure die in accordance with pre-programmed parameters.

2. Description of the Related Art

Tube bending machines are well-known in the art. In one common type of machine, a tube is secured between a bend die and a clamp die which rotate together, drawing the lead portion of the tube therewith to bend it around the bend die. A pressure die engages an outside wall of the trailing portion of the tube to counter the reaction force of the tube during the bending operation. When the tube is being bent, the outside wall of the tube is reduced in thickness due to stretching of the material and the inside wall of the tube is increased in thickness due to compression of the material. The material that forms the outside wall of the bend is stretched because it has a longer distance to travel and the material that forms the inside wall of the bend is compressed because it has a shorter distance to travel. The end result is wall thinning of the outside walls and increased ovalty of the tube diameter. These problems are even greater when bending tubes at tight radii such as, for example about 1 to about 1.5 times the diameter of the tube, where drag on the pressure die increases to cause the material to break during the bending operation. The Boiler industry typically does not accept wall thinning below 10% of the specified wall thickness because of the high pressures at which fluids pass through the bent tubes. Additionally, the boiler industry typically requires ovalty to be maintained within 10% of the specified tube diameter and cross-sectional area to be maintained within 20% of the specified cross-sectional area of the tube because of increased resistance to flow.

Several methods have been tried and used to maintain the wall thickness of a bent tube within specified limits. The most commonly used method is to heat the tube to an elevated temperature before or during the bending operation, thereby changing its mechanical properties during the bending operation. The tube is easier to bend when the material is hot and stretching of the outer wall is much less compared to stretching of the outer wall when cold bending. Hot bending, however, increases costs and is difficult for an operator to handle. Hot bending also distorts the tube which requires further processing to bring the tube back to within specified limits.

Another method to maintain the tube within specified limits is to have a boost system for the pressure die. The pressure die is driven forward or boosted along with the trailing portion of the tube at a speed which is greater than the speed of the trailing portion of the tube as it is pulled forward by the bend die during bending. Such boost systems help insure that the outer wall of the tube will not be stretched so as to have an undesirably thin section. Pressure dies typically have a semi-circular groove cut for receiving a specific size of tube. The pressure die typically follows the tube solely because of friction between the tube and the pressure die. Varying results are obtained, therefore, because substantial slippage can occur between the tube and the pressure die.

Pressure die boost systems are also typically hydraulic systems with a valves which are manually adjusted to change the amount of boost. See for example, U.S. Pat. No. 4,765,168, which is expressly incorporated herein in its entirety by reference. These type of boost systems, however, are imprecise in that the pressure die movement can vary between different bending operations. Accordingly, there is a need in the art for an improved tube bending machine which can repeatably cold bend thick walled tubes within acceptable limits.

SUMMARY OF THE INVENTION

The present invention provides a tube bending machine which overcomes at least some of the above-described problems of the related art. The tube bending machine includes a rotatable bend die, a clamp die rotatable with the bend die, and a pressure die. The tube is bent around the bend die and at least a portion of the bend die has a pinch-type tube groove which securely clamps the tube and substantially prevents relative movement between the bend die and an inside wall of the tube. The clamp die is disposed radially outward of the bend die and is movable toward the bend die to securely clamp the tube between the clamp die and the bend die at a location adjacent a selected location on the tube for the bend. The pressure die engages with an outside wall of the tube trailing the selected location on the tube for the bend and exerts a generally tangential pressure on the tube. The pressure die has a pinch-type tube groove which securely clamps the tube and substantially prevents relative movement between the pressure die and the outside wall of the tube. The tube bending machine also includes a pressure die boost system which linearly advances the pressure die in a forward direction as the bend die is rotated. The pressure die boost system includes a linear actuator connected to the pressure die and an electro-hydraulic control system which automatically drives the linear actuator during the bending operation in accordance with pre-programmed parameters.

BRIEF DESCRIPTION OF THE DRAWINGS

These and further features of the present invention will be apparent with reference to the following description and drawings, wherein.

DETAILED DESCRIPTION OF THE PREFERRED EMBODIMENT

Figure 1:
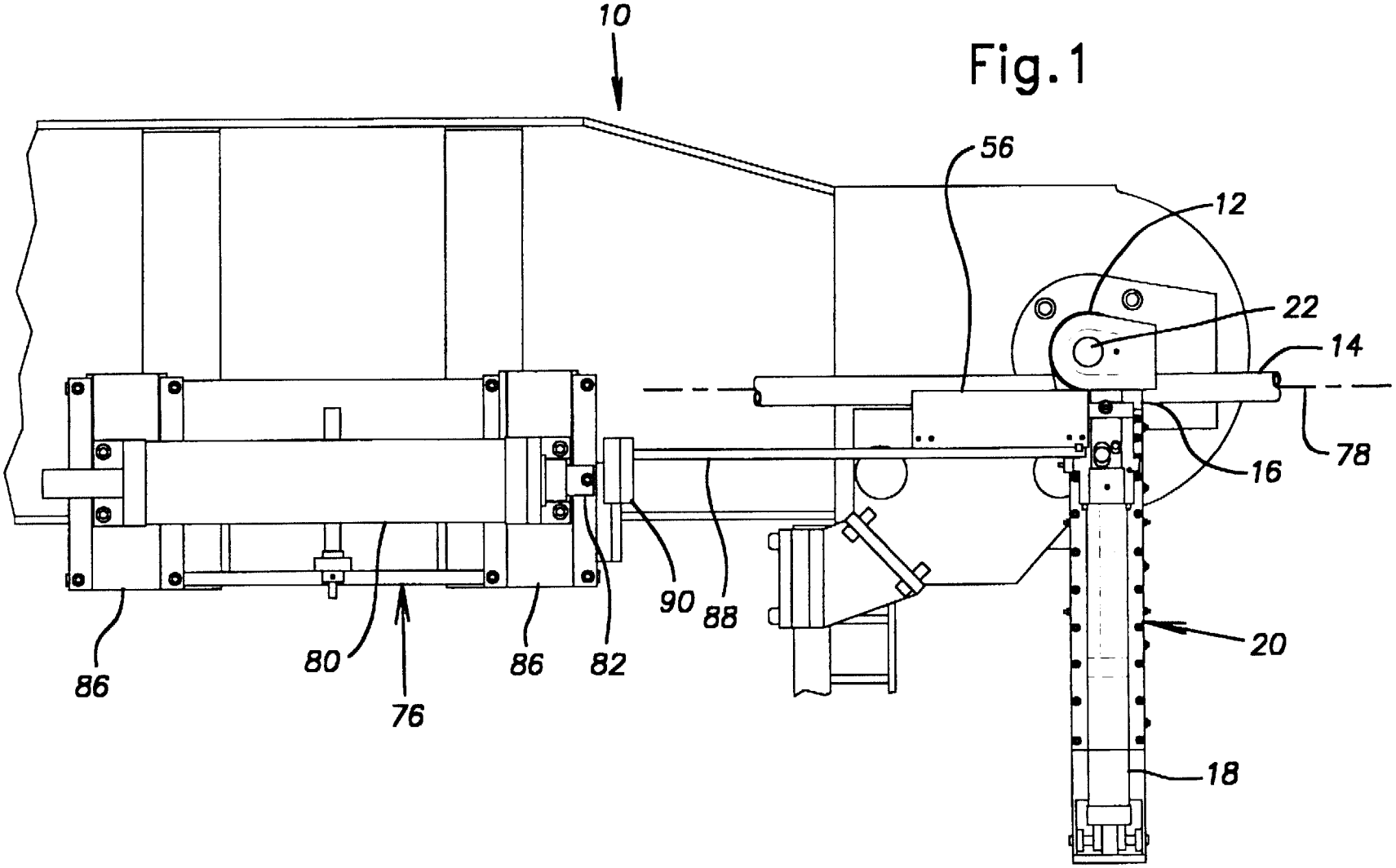
FIG. 1 is a top plan view of a tube bending machine according to the present invention.

FIG. 1 illustrates a tube bending machine 10 having a bend die 12 around which a tube 14 is formed. The tube 14 is held against the bend die 12 during a bending operation by a clamp die 16 which is advanced and retracted by an actuator 18 before and after the bending operation respectively. The bend die 12 is attached to a bend or swing arm 20 which is mounted for rotational movement about one end of the tube bending machine 10. The swing arm 20 also houses the clamp die 16 and actuator 18. The swing arm 20 is rotated about a vertical rotational axis 22 by a drive system (not shown) which includes an encoder which electronically encodes the angular position of the swing arm 20 to provide the angular position of the bend die 12 at all times during the bend operation.

Figure 7:
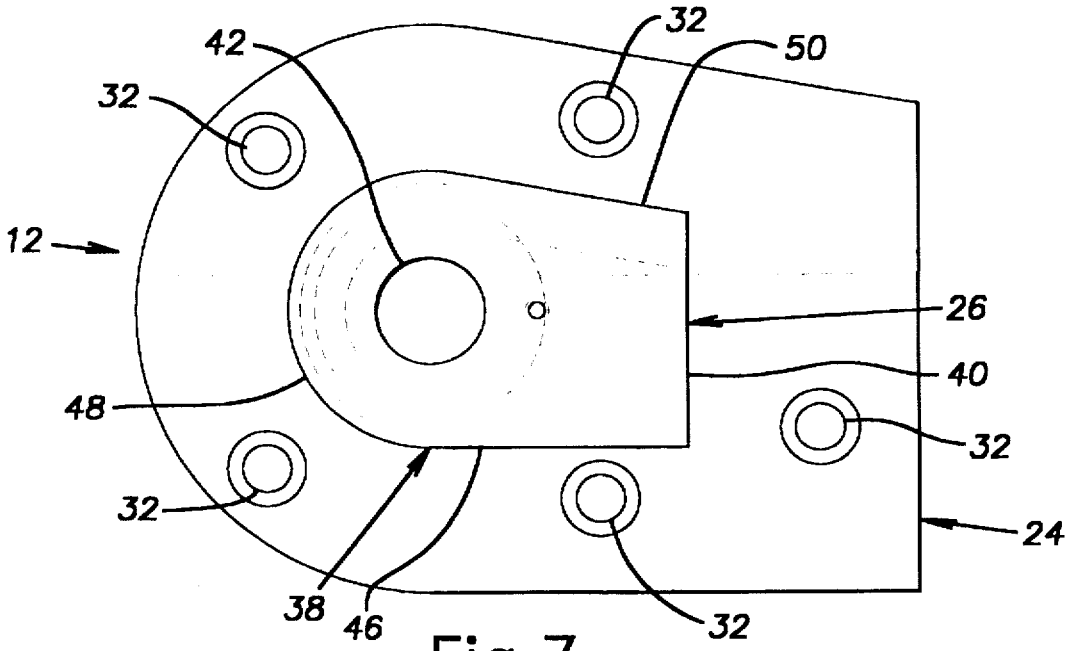
FIG. 7 is a top plan view of the bend die.
Figure 8:
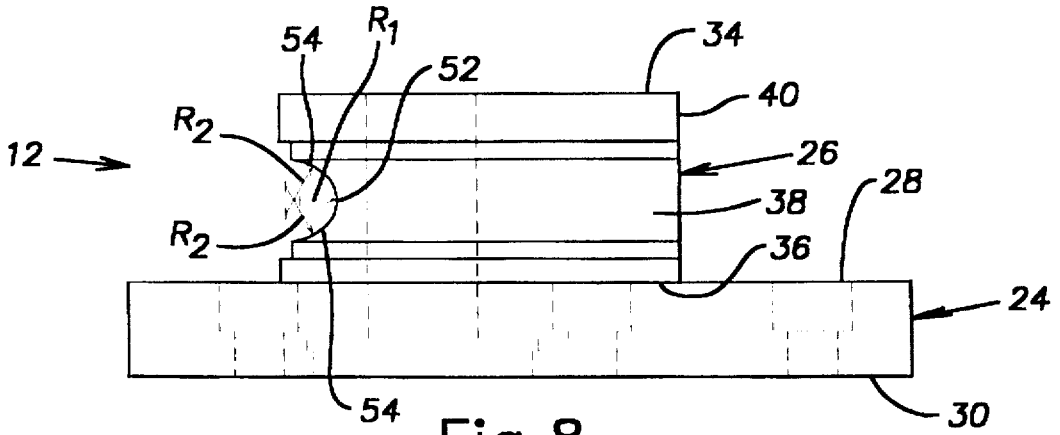
FIG. 8 is a side elevational view of the bend die.

As shown in FIGS. 7 and 8, the bend die 12 includes mounting portion 24 and a die portion 26. The mounting portion 24 is a generally U-shaped plate having generally parallel and flat top and bottom surfaces 28, 30. The mounting portion 24 includes a plurality of openings 32 for accepting fasteners to attach the bend die 12 to the swing arm 20. The die portion 26 is a generally U-shaped block having parallel and flat top and bottom surfaces 34, 36. The bottom surface 36 of the die portion 26 is integral with the top surface 28 of the mounting portion 24. A die cavity or groove 38 is formed in and circumscribes an outer peripheral surface of the die portion 26 except for a squared end surface 40. A central opening 42 extends through the thickness of the bend die 12 and is coaxial with a portion of the groove 38. The central opening 42 is sized to receive an upper end of a spindle (not shown) of the drive system of the swing arm 20. The bottom surface 30 of the mounting portion 24 defines a keyway 44 sized to receive a key to secure the bend die 12 to the swing arm 20 such that the bend die 12 is rotated with the swing arm 20.

As viewed in the plan view of FIG. 7, the groove 38 includes a generally straight first or clamp portion 46 which merges into a generally semi-circular second or bend portion 48. The bend portion 48 extends slightly more than 180 degrees and merges into a generally straight third or end portion 50 opposite the first portion 46 which converges in a rearward direction toward the first portion 46. In cross-section, the clamp and end portions 46, 50 of the groove 38 are each generally semi-circular having a radius of curvature substantially corresponding to the nominal outside diameter of the tube 14. As shown in FIG. 8, the bend portion 48 of the groove 38 is a pinch-type groove, that is, the groove 38 is generally oval-shaped in cross-section and is generally undersized for the tube 14. The pinch-type portion of the groove 38 is sized and shaped such that the top and bottom of the tube 14 is squeezed together or pinched to slightly deform the tube 14.

The illustrated pinch-type portion of the bend die groove is formed such that a radius of curvature $R_1$ of a bottom portion 52 of the groove 38 is less than one-half the diameter of the tube 14 while a radius of curvature $R_2$ of opposite side portions 54 of the groove 38 is greater than one-half the diameter of the tube 14. The center of curvature for each of the side portions 54 is eccentrically located with respect to the center of curvature of the bottom portion 52 of the groove 38 in order to establish a smooth transition from the radius of curvature $R_1$ of the bottom portion 52 of the groove 38. The transition between the different radii $R_1$, $R_2$ is completed by grinding the two radii $R_1$, $R_2$ to eliminate any irregularity in the groove 38. The depth of the groove 38 is greater than one-half the nominal outside diameter of the tube 12 and the width or opening of the groove 38 is less than the nominal outside diameter of the tube 14 such that the top and bottom of the tube 14 is deflected inwardly by the side portions 54 of the groove 38. Space is provided adjacent the bottom portion 52 of the groove 38 so that the inner side wall of the tube 14 can deflect into the groove 38 as a result of the inward pinching of the top and bottom of the tube 14. The bend die preferably has a bottom portion radius of curvature $R_1$ of about 0.754 inches, a side portion radius of curvature $R_2$ about 1.167 inches, a depth of about 0.920 inches, and a width of about 1.735 inches, for a tube 14 having a nominal outside diameter of 1.75 inches.

The multi-radius configuration continues throughout the bend portion 48 of the bend die 12 and undergoes a transition into the semi-circular clamp and end portions 46, 50 of the bend die 12. The transition is preferably accomplished by causing the bottom portion 52 of the bend portion 48 to slope upwardly at a gradual angle of about 5 degrees until it reaches the bottom portion of the clamp and end portions 46, 50. The sloping occurs at points beginning at each end of the bend portion 48 and continuing through a limited distance into the clamp and end portions 46, 50 depending on the diameter of the tube 14.

The tube 14 is also held against the bend die 12 by a pressure die 56 which counters the reaction force of the tube 14 during the bending operation. A preferred form of the pressure die 56 is shown in FIGS. 7 and 8. The pressure die 56 is generally rectangularly-shaped having parallel top and bottom surfaces 58, 60, parallel leading and trailing end surfaces 62, 64, and parallel inner and outer side surfaces 66, 68. A die cavity or groove 70 is formed in the inner side surface and extends the full length of the pressure die 56. The groove 70 of the pressure die 56 is a pinch-type groove as discussed above for the bend die 12. The depth of the groove 70, however, is less than one-half the nominal outside diameter of the tube 14 so that a bottom portion 72 of the groove 70 engages and inwardly deforms the outer side of the tube 14. The width or opening of the groove 70, like the bend die 12, is less than the nominal outside diameter of the tube 14 so that the top and bottom of the tube 14 is pinched or squeezed together, but to a larger extent than the bend die 12, to substantially eliminate relative movement between the pressure die 56 and the tube 14 during a bend operation. The pressure die 56 preferably has a groove 70 with a bottom portion radius of curvature $R_3$ of about 0.731 inches, a side portion radius of curvature $R_4$ of about 1.167 inches, a depth of about 0.796 inches, and a width of about 1.691 inches, for a tube 14 having a nominal outside diameter of 1.75 inches.

The leading end 62 of the pressure die 56 is given a semi-circular configuration corresponding to the nominal outside diameter of the tube 14 that slopes or merges into the oval or pinch-type portion of the groove 70 which traverses the length of the pressure die 56. The transition slope of the semi-circular portion of the groove 70 is on the order of 5 degrees. As with the bend die 12, a gradual transition between the various portions of the groove 70 can be accomplished by grinding along a gradual angle to avoid corners or irregularities which could scar the outer surface of the tube 14.

Figure 2:
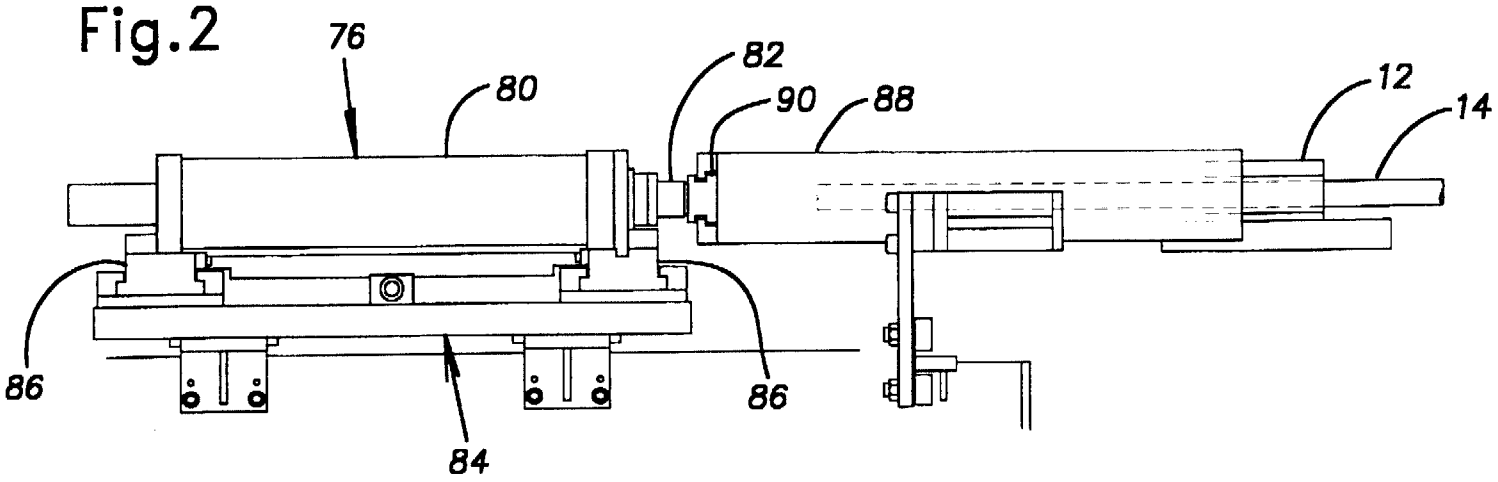
FIG. 2 is a side elevational view of a pressure die assist boost assembly of the tube bending machine of FIG. 1.

As shown in FIGS. 1 and 2, a pressure die assist boost system 76 is provided to horizontally move the pressure die 56 parallel to a longitudinal axis 78 of the tube 14. The forward movement of the pressure die 56 boosts the forward motion of the outer wall of the tube 14 during bending. The pressure die assist boost system 76 includes a high pressure hydraulic cylinder 80 having a plunger or pusher 82. The hydraulic cylinder 80 of the preferred embodiment is available from the Parker Corporation, Part No. 2CBB2HLT14AC10. The cylinder 80 is mounted such that the pusher 82 travels parallel to the longitudinal axis 78 of the tube 14. The cylinder 80 is mounted to a base assembly 84 by a pair of slides 86 oriented such that the cylinder 80 can horizontally travel in a transverse direction, that is, travel in a direction perpendicular to the direction of travel of the pusher 82. The pressure die 56 is attached to an end of an elongated rectangular follower or master bar 88 which is attached at the other end to the pusher 82 by a gib assembly 90.

Figure 9:
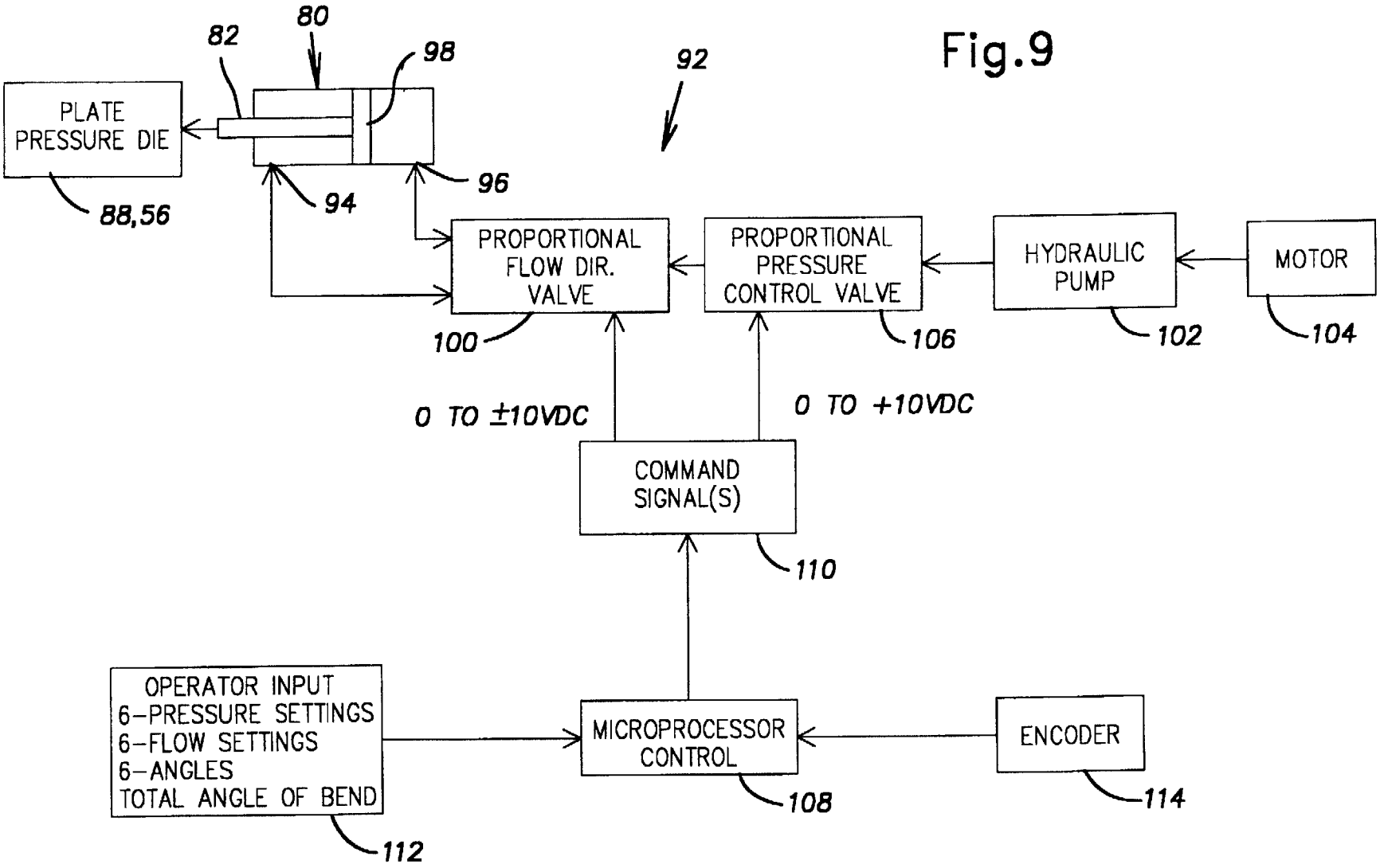
FIG. 9 is a functional block diagram of an electro-hydraulic control system of the pressure die assist boost system.

The pressure die assist boost system 76 also includes a programmable electro-hydraulic control system 92 as diagrammatically illustrated in FIG. 9. The control system 92 is an open loop-type control system in that while movement of the pressure die 56 is being controlled there is no feed-back as to the actual movement of the pressure die 56. The cylinder 80 includes ports 94, 96 for receiving hydraulic fluid under pressure on opposed sides of a piston 98. The fluid ports 94, 96 are connected to a proportional flow directional valve 100 which directs hydraulic fluid to and from each of the ports 94, 96 of the cylinder 80 with variable flow. The proportional flow directional valve 100 of the preferred embodiment is available from the Parker Corporation, Part No. D31FH02CVB0020. The proportional flow directional valve 100 operates with a command signal which ranges from 0 to +/−10 volts d.c. The proportional flow directional valve 100 operates linearly except at the low end of the range where a command signal of 0 volts d.c. obtains no flow, a command signal of +10 v. dc. obtains full flow in one direction, and a command signal of −10 volts dc obtains full flow in the other direction. Full flow is limited by the capacity of the pump 102 which preferably is a separate pump used only for this control system 92 so that the full capacity of the pump 102 is available to drive the cylinder 80.

The hydraulic fluid is supplied from a variable displacement pressure compensated hydraulic pump 102 which is driven by an electric motor 104. The hydraulic pump 102 of the preferred embodiment is rated at 20 GPM, 0–2000 psi, and the electric motor 104 of the preferred embodiment is rated at 30 hp and 1800 rpm. The proportional flow directional valve 100 is connected to the hydraulic pump 102 with a proportional pressure reducing valve 106. The proportional pressure reducing valve 106 of the preferred embodiment is available from the Parker Corporation, Part No. D31FHE02CVB0020. The proportional pressure reducing valve 106 operates with a command signal which ranges from 0 to 10 volts d.c. The proportional pressure reducing valve 106 operates linearly except at the low end of the range where a command signal of 0 volts d.c. obtains minimum pressure, such as 200 psi, and a command signal of 10 v. dc. obtains full pressure. Preferably, the valve 106 is capable of handling pressure up to about 3,000 psi.

A microprocessor based controller 108 supplies control signals 110 to both the proportional flow direction valve 100 and the proportional pressure reducing valve 106. The controller 108 is in communication with the swing arm encoder 114 so that the controller receives the angular position of the bend die 12 at all times during the bending operation. Both the magnitude of force and speed generated by the pressure die boost system 76 are variable and can be pre-programmed into the controller 108. Software for the controller 108 allows the operator to pre-program the controller 108 by imputing data 112 such as the total angle the tube 14 is to be bent, angles at which a speed or pressure change is desired, and the flow and pressure desired at each of the angles. The controller 108 of the preferred embodiment allows up to six angles of the total bend to input with flow and pressure specified at each of the angles. The number of angles, however, is set only by the software and can alternatively be greater or smaller.

The controller 108 preferably allows the pressure level to be programmed from about 300 psi to about 3000 psi (or the maximum output of the pump 102) and allows the flow to be programmed from 0 GPM to 20 GPM (or the maximum output of the pump 102). It is noted that because flow and pressure are interdependent, only one of the parameters can be dominant at any given time. For example, if the flow of hydraulic fluid into the hydraulic cylinder 80 is less than required to reach the required speed, pressure cannot be controlled. Since both pressure and flow are under software control the operator can change the dominant parameter at any time during the bend operation. according to the software of the preferred embodiment, the operator inputs the flow and pressure levels as a percentage of the maximum system flow and pressure, however, the software can alternatively accept units of psi. The controller converts the percentage to the proper command signal. For example, if a 100% flow requirement is input, the controller 108 sends a 10 volt dc signal to the proportional flow directional valve 100.

Optimum variations in the speed and the pressure of the pressure die 56 are arrived at largely by trial and error for each particular type and size of tube 14. Reference is made to Table 1 which illustrates variations of speed and pressure which were found to be suitable for an ASTM SA210 steel tube 14 having an outer diameter of 1.75 inches and a wall thickness of 0.180–0.250 inches.

TABLE 1

| | Angle (degrees) | FLOW (% of total) | Pressure (% of total) |
|---|---|---|---|
| 1. | 1.5 | 62 | 20 |
| 2. | 5.0 | 34.5 | 100 |
| 3. | 20.0 | 34.8 | 100 |
| 5. | 170.0 | 20 | 50 |

Figure 4:
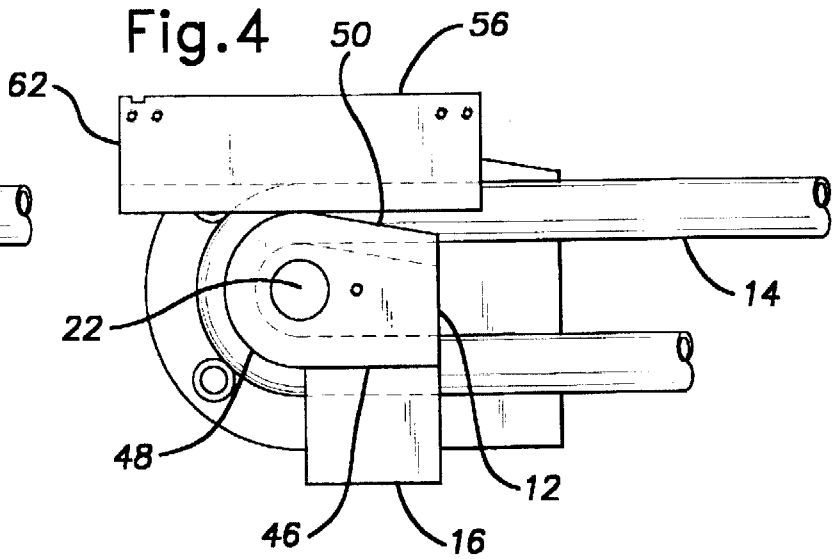
FIG. 4 is a top plan view illustrating the interrelationship between the bend die, the clamp die, and the pressure die at the completion of a 180 degree bend.
Figure 3:
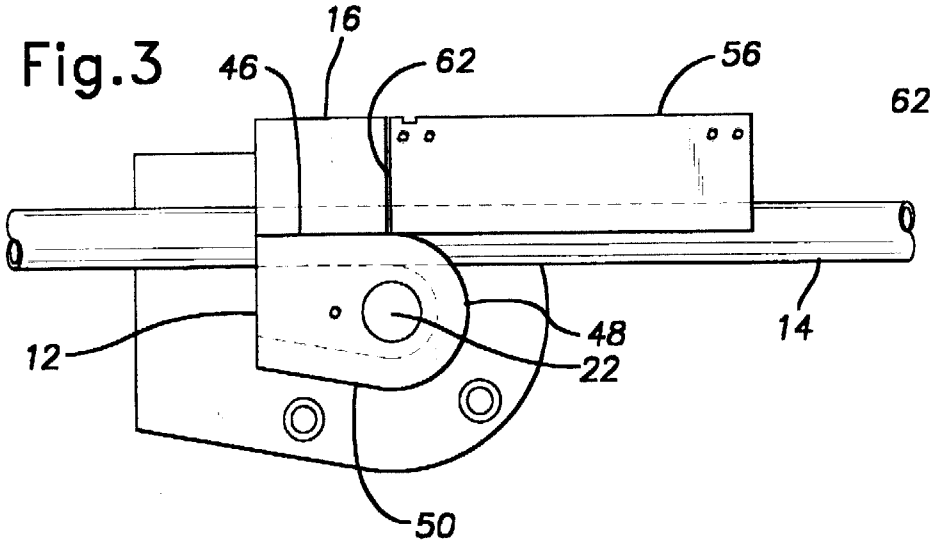
FIG. 3 is a top plan view illustrating the interrelationship between the bend die, the clamp die and the pressure die at the initiation of a bend.
Figure 5:
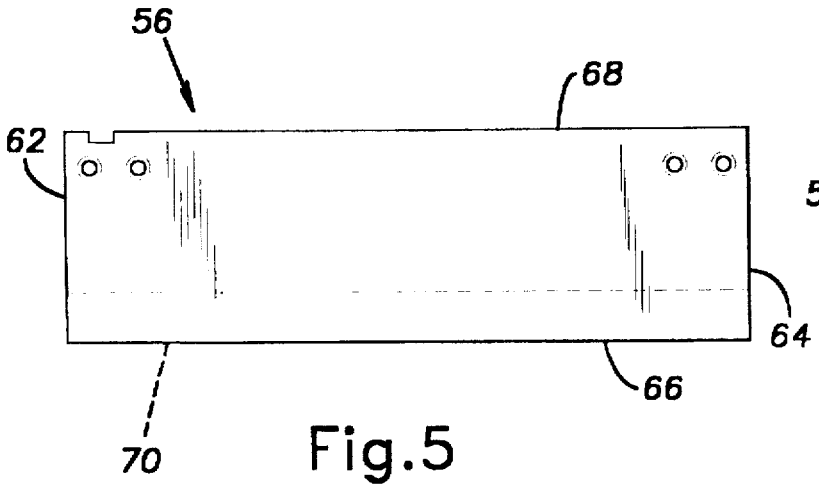
FIG. 5 is a top plan view of the pressure die.
Figure 6:
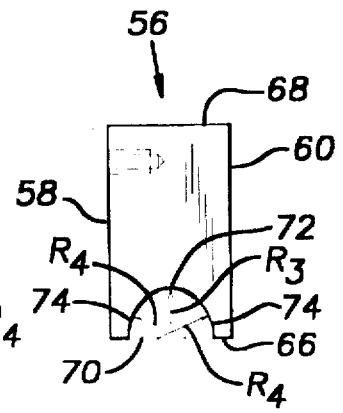
FIG. 6 is a side elevational view of the pressure die.

During operation, the first step is to enter a part program into the controller 108 which will set the parameters to preselected levels from memory, or alternatively, the operator can directly input parameters to establish a boost profile. The parameters input are preferably up to 6 angles of bend during a complete bend cycle, percentage of total flow desired at each of the input angles, and percentage of total pressure desired at each of the input angles. As shown in FIG. 3, at the beginning of a bend operation the tube 14 is clamped between the bend die 12 and the clamp die 16 which is aligned with the clamp portion 46 of the bend die groove 38. The pressure die 56 is in abutting relation to the end of the clamp die 16 such that the leading end 62 of the pressure die is positioned at the transition of the clamp and the bend portions 46, 48 of the bend die 12. The pinch groove 70 of the pressure die 56 firmly clamps the tube 14 to substantially eliminate relative movement between the tube 14 and the pressure die 56. The bend die 12 and the clamp die 16 are rotated by the swing arm 20 at a constant rate of speed such as, for example, 5 to 6 rpm. Simultaneously, the pressure die 56 is advanced by the pressure die assist boost system 76 in a linear direction to maintain bending pressure on the tube 14 as the bend die 12 is rotated. The controller 108 receives signals from the swing arm encoder 114 representative of the angular position of the bend die 12 and automatically sends command signals to the proportional flow direction valve 100 and the proportional pressure control valve 106 to vary the speed and pressure of the pressure die 56 according to the pre-programmed data 112. The action of the pressure die 56 minimizes stretching or thinning of the outer wall of the tube 14. As shown in FIG. 4, after rotating the bend die 12 about 180 degrees, the pressure die 56 is located adjacent the end portion 50 of the bend die 12.

Although particular embodiments of the invention have been described in detail, it will be understood that the invention is not limited correspondingly in scope, but includes all changes and modifications coming within the spirit and terms of the claims appended hereto.

What is claimed is:

1. A tube bending machine for cold bending at least one bend in a tube, said tube bending machine comprising:

a rotatable bend die about which the tube is bent, at least a portion of said bend die having a pinch-type tube groove for receiving an inner side wall of the tube and substantially preventing relative movement between said bend die and the inside wall of the tube;

a rotatable clamp die disposed outwardly of said bend die and movable to secure the tube between the clamp die and the bend die at a location adjacent a selected location for the bend;

a pressure die engagable with an outside wall of the tube trailing the selected location for the bend to exert a generally tangential pressure on the tube, said pressure die having a pinch-type tube groove with multiple radiuses for receiving the tube to substantially prevent relative movement between the pressure die and the outer side wall of the tube; and a pressure die boost system for advancing said pressure die in a forward direction as said bend die is rotated, said boost system comprising:

a actuator including a hydraulic cylinder with a piston, a pusher coupling said piston to said pressure die, and ports in said cylinder on opposite sides of said piston; and an electro-hydraulic control system for automatically driving said actuator in accordance with pre-programmed parameters, said electro-hydraulic control system including a hydraulic pump for providing hydraulic fluid to said cylinder, a proportional flow directional valve connected to said ports for varying flow of the hydraulic fluid from said hydraulic pump to each of said ports of said cylinder, a proportional pressure control valve connecting said hydraulic pump to said proportional flow directional valve for varying pressure of the hydraulic fluid, a sensor for detecting a rotational angle of said bend die, and a controller in electrical communication with said sensor for receiving a signal from said sensor representative of said rotational angle and with said proportional flow directional valve and said proportional pressure control valve for providing control signals to set flow and pressure of the hydraulic fluid to pre-selected levels at pre-selected angles of said bend die.

2. The tube bending machine according to claim 1, wherein data pre-programmed into said controller includes a plurality of bend angles, a plurality flow settings for said proportional flow directional valve corresponding to said bend angles, and a plurality of pressure settings for said proportional pressure control valve corresponding to said bend angles.

3. The tube bending machine according to claim 2, wherein each of said flow settings is input as a percentage of a maximum flow of said electro-hydraulic system and each of said pressure settings is input as a percentage of maximum pressure of said electro-hydraulic system.

4. The tube bending machine according to claim 2, wherein said data pre-programmed into said controller includes at least one selection of a dominant parameter.

5. A tube bending machine for placing at least one bend in a tube, said tube bending machine comprising:

a rotatable bend die about which the tube is bent, at least a portion of said bend die having a pinch-type tube groove for receiving an inner side wall of the tube and substantially preventing relative movement between said bend die and the inside wall of the tube;

a rotatable clamp die disposed outwardly of said bend die and movable to secure the tube between the clamp die and the bend die at a location adjacent a selected location for the bend;

a pressure die engagable with an outside wall of the tube trailing the selected location for the bend to exert a generally tangential pressure on the tube, said pressure die having a pinch-type tube groove for receiving the tube to substantially prevent relative movement between the pressure die and the outer side wall of the tube; and a pressure die boost system for linearly advancing said pressure die in a forward direction as said bend die is rotated, said boost system including an actuator connected to said pressure die and an electro-hydraulic control system for automatically driving said actuator in accordance with a pre-programmed profile of pre-determined pressure and flow parameters for different bend angles for each size and thickness of tubing, said electro-hydraulic control system including a controller and a hydraulic pump, wherein data preprogrammed into said controller includes a plurality of bend angles, a plurality of flow rates from said pump to said actuator and corresponding to said bend angles, and a plurality of fluid pressures from said pump to said actuator and corresponding to said bend angles, whereby consistent, uniform bends of the tubing may be realized which minimize thickness and diameter changes for each size and thickness of tubing.

6. The tube bending machine according to claim 5, wherein said linear actuator includes a hydraulic cylinder with a piston, a pusher coupling said piston to said pressure die, and ports in said cylinder on opposite sides of said piston, said electro-hydraulic control system further includes a proportional flow directional valve connected to said ports for varying flow of hydraulic fluid from said hydraulic pump to each of said ports of said cylinder, and a proportional pressure control valve connecting said hydraulic pump to said proportional flow directional valve for varying pressure of hydraulic fluid, and said controller is in electrical communication with said proportional flow directional valve and said proportional pressure control valve for providing control signals to set flow and pressure of hydraulic fluid to preselected levels.

7. The tube bending machine according to claim 5, wherein each of said flow rates is input as a percentage of a maximum flow of said hydraulic pump and each of said fluid pressures is input as a percentage of maximum pressure of said hydraulic pump.

8. The tube bending machine according to claim 5, wherein said pinch-type groove of said pressure die has multiple radiuses.

9. The tube bending machine according to claim 5, wherein said pinch-type groove of said pressure die is generally oval-shaped.

10. The tube bending machine according to claim 5, wherein said data pre-programmed into said controller includes at least one selection of a dominant parameter.

11. The tube bending machine according to claim 6, wherein said electro-hydraulic system includes a sensor for detecting a rotational angle of said bend die and said controller is electrically connected to said sensor for receiving a signal from said sensor representative of said rotational angle, said controller setting flow and pressure of the hydraulic fluid to said preselected levels at preselected rotational angles of said bend die.

12. The tube bending machine according to claim 10, wherein said data pre-programmed into said controller includes a plurality of sections of a dominant parameter corresponding to said bend angles.

13. A pressure die boost system for a tube bending machine having a rotatable bend die around which a tube is bent and a pressure die engaging an outside wall of the tube tangential to the bend, said pressure die boost system comprising:

a hydraulic cylinder with a piston, a pusher coupling said piston to said pressure die, and ports in said cylinder on opposite sides of said piston; and an electro-hydraulic control system for automatically driving said piston in accordance with predetermined and pre-programmed pressure and flow parameters for different bend angles, said electro-hydraulic control system including a hydraulic pump for providing hydraulic fluid to said cylinder, a proportional flow directional valve connected to said ports for varying flow of the hydraulic fluid from said hydraulic pump to each of said ports, a proportional pressure control valve connecting said hydraulic pump to said proportional flow directional valve for varying pressure of the hydraulic fluid, and a controller in electrical communication with said proportional flow directional valve and said proportional pressure control valve for providing control signals to set flow and pressure of the hydraulic fluid.

14. The tube bending machine according to claim 13, wherein data pre-programmed into said controller includes a plurality of bend angles, a plurality flow settings for said proportional flow directional valve corresponding to said bend angles, and a plurality of pressure settings for said proportional pressure control valve corresponding to said bend angles.

15. The tube bending machine according to claim 13, wherein said pressure die has a pinch-type tube groove for receiving the tube to substantially prevent relative movement between the pressure die and the outer side wall of the tube.

16. The tube bending machine according to claim 14, wherein each of said flow settings is input as a percentage of a maximum flow of said electro-hydraulic system and each of said pressure settings is input as a percentage of maximum pressure of said electro-hydraulic system.

17. The tube bending machine according to claim 14, wherein said electro-hydraulic system includes a sensor for detecting a rotational angle of said bend die and said controller is electrically connected to said sensor for receiving a signal from said sensor representative of said rotational angle.

18. The pressure die boost system according to claim 9, wherein said data pre-programmed into said controller includes at least one selection of a dominant parameter.

19. The tube bending machine according to claim 15, wherein said pinch-type groove of said pressure die has multiple radiuses.

20. The tube bending machine according to claim 15, wherein said pinch-type groove of said pressure die is generally oval-shaped.

* * * * *

UNITED STATES PATENT AND TRADEMARK OFFICE

CERTIFICATE OF CORRECTION

PATENT NO. : 5,784,913

DATED : July 28, 1998

INVENTOR(S) : Ajay K. Bhandari

It is certified that error appears in the above-indentified patent and that said Letters Patent is hereby corrected as shown below:

Claim 1, column 7, line 33, please delete the first occurrence of "a" and insert therefor --an--.

Claim 18, column 10, line 26, please delete "9" and insert therefor --14--.

Signed and Sealed this

Fifteenth Day of December, 1998

Bruce Lehman

*Attest:*

BRUCE LEHMAN

*Attesting Officer*

*Commissioner of Patents and Trademarks*